US008313878B2

(12) United States Patent
Kuramashi

(10) Patent No.: US 8,313,878 B2
(45) Date of Patent: Nov. 20, 2012

(54) TONER SET, DEVELOPER SET, IMAGE FORMING APPARATUS AND IMAGE FORMING METHOD

(75) Inventor: Koji Kuramashi, Osaka (JP)

(73) Assignee: Kyocera Mita Corporation (JP)

( * ) Notice: Subject to any disclaimer, the term of this patent is extended or adjusted under 35 U.S.C. 154(b) by 232 days.

(21) Appl. No.: 12/857,943

(22) Filed: Aug. 17, 2010

(65) Prior Publication Data

US 2011/0053072 A1 Mar. 3, 2011

(30) Foreign Application Priority Data

Aug. 26, 2009 (JP) ..... 2009-195223

(51) Int. Cl.
*G03G 9/08* (2006.01)

(52) U.S. Cl. ..... 430/107.1; 430/108.8; 430/123.5; 430/123.57; 399/252

(58) Field of Classification Search ..... 430/107.1, 430/108.8, 123.5, 123.57; 399/252
See application file for complete search history.

(56) References Cited

U.S. PATENT DOCUMENTS

2005/0158645 A1* 7/2005 Kobayashi et al. ..... 430/108.4
2006/0228639 A1* 10/2006 Young et al. ..... 430/108.4
2007/0217829 A1 9/2007 Tanida

FOREIGN PATENT DOCUMENTS

JP 3-107869 5/1991
JP 2004-70005 3/2004

* cited by examiner

*Primary Examiner* — Mark A Chapman
(74) *Attorney, Agent, or Firm* — Gerald E. Hespos; Michael J. Porco

(57) ABSTRACT

A toner set has toners used in an image forming method by forming a toner image with toners of several colors and fixing the toner image onto a recording medium. The toners include first and second toners of different colors. The first and second toners contain toner base particles including a binding resin, a colorant and a wax. The colorant of the first toner contains a quinacridone pigment. The wax includes a carnauba wax and a wax other than the carnauba wax. The base particles of the first toner have a mass % $W_{q1}$ of carnauba wax and $W_{o1}$ of the other wax and the base particles of the second toner have a mass % $W_{q2}$ of carnauba wax and $W_{o2}$ of the other wax. These mass % values are selected to satisfy the following:

$$W_{q1}/(W_{q1}+W_{q2})<W_{o1}/(W_{o1}+W_{o2})$$

$$3\leqq W_{o1}+W_{o2}<W_{q1}+W_{q2}\leqq 10.$$

7 Claims, 1 Drawing Sheet

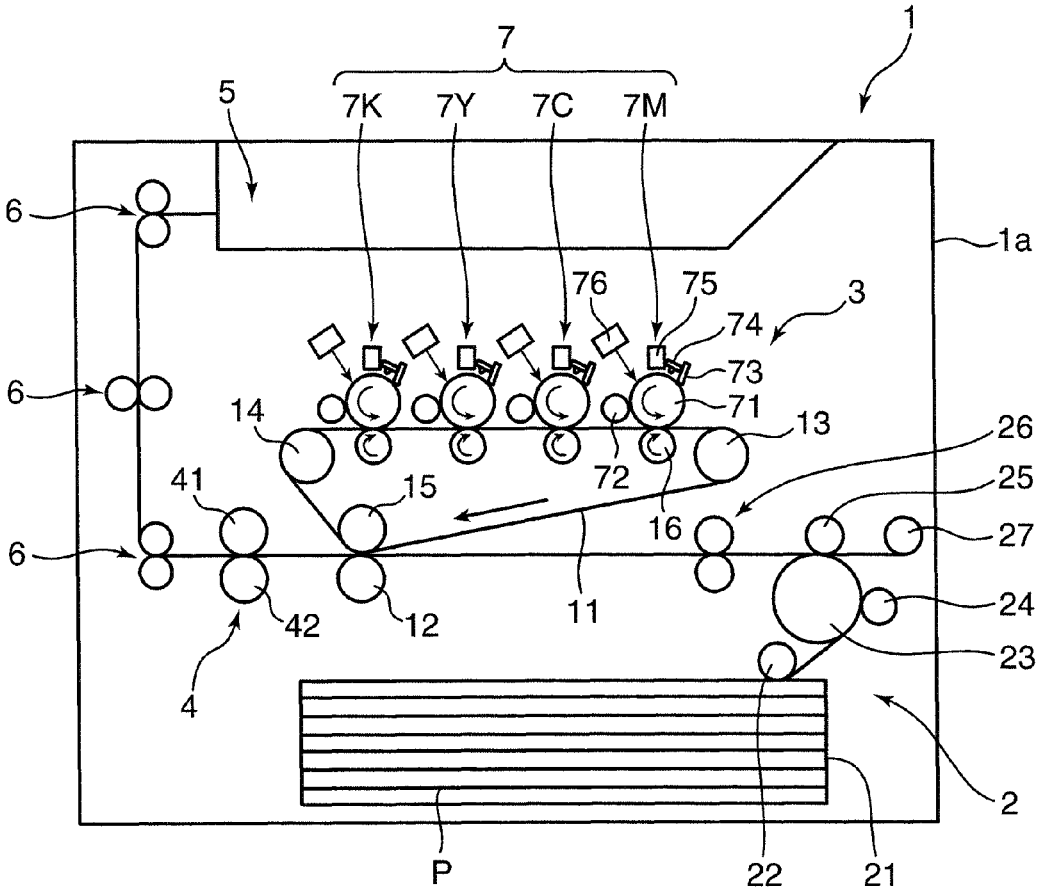
1
7
5
7K
7Y
7C
7M
6
1a
76
75
3
74
73
6
14
71
13
26
41
15
72
25
16
27
6
42
12
11
24
23
4
2
P
22
21

TONER SET, DEVELOPER SET, IMAGE FORMING APPARATUS AND IMAGE FORMING METHOD

BACKGROUND OF THE INVENTION

1. Field of the Invention

The present invention relates to a toner set, a developer set, an image forming apparatus and an image forming method.

2. Description of the Related Art

An image forming apparatus which employs an electrophotographic method, such as a copying machine, a printer, a facsimile device, or a composite of these, comprises: an image bearing member, a charger for uniformly charging the surface of the image bearing member, a developing device for forming an electrostatic latent image on the image bearing member, a developing device for developing the electrostatic latent image on the image bearing member into a toner image, a transfer device for transferring the toner image on the image bearing member, onto a recording medium, and the like. The image forming apparatus described above forms an image on a recording medium by transferring a toner image onto a recording medium as described above by means of respective devices.

Image formation apparatuses of this kind are used not only for monochrome printing, but may also be equipped with a color printing function for forming color images. More specifically, for example, an image forming apparatus such as a one-drum color copying machine or a composite device (MFP) which comprises one photoconductive drum is used. However, when printing a color image on one sheet of paper, an image forming apparatus of this kind based on a one-drum system is required to form an image on a photoconductive drum, which is the image bearing member, for respective developing actions onto the paper of each of the colors of black, yellow, cyan and magenta, and the like. Therefore, a problem has arisen in that the printing speed when performing color printing falls to around ¼ the printing speed when performing monochrome printing. In other words, color printing is problematic in requiring approximately four times as long as monochrome printing. Therefore, there have been requirements to shorten the printing time, in other words, to speed up printing, in an image forming apparatus comprising a color printing function. A tandem-system color image forming apparatus, or the like, is one example of an apparatus which satisfies requirements of this kind.

A color image forming apparatus based on a tandem system is, more specifically, an image forming apparatus which comprises, for example, an intermediate transfer belt for secondary transfer onto a transfer receiving medium, such as paper, after primary transfer of a toner image formed on an image bearing member by an electrophotographic method, and which forms a color image by mutually superimposing toner images of a plurality of colors, such as yellow (Y), magenta (M), cyan (C) and black (K), or the like, on the intermediate transfer belt. In a color image forming apparatus of this kind, in order to mutually superimpose toner images of a plurality of colors, developing devices corresponding to the respective colors are arranged in line following the intermediate transfer belt. A color image is formed by successively transferring the toner images of the four colors of YMCK formed on respective photoconductive drums of the developing devices, onto an intermediate transfer belt (primary transfer). The color image which has been formed on this intermediate transfer belt is transferred onto a transfer receiving material, such as paper, by secondary transfer rollers which are situated facing the intermediate transfer body (secondary transfer). By forming toner images corresponding to the respective color on the respective image bearing members in this way, and then mutually superimposing these toner images to form a color image, a tandem-system color image forming apparatus can achieve high-speed printing.

On the other hand, toner such as that described below can be cited as an example of the toner used in an image forming apparatus which employs an electrophotographic method.

A first example is color toner in which a processed pigment obtained by kneading a magenta pigment made of a polyolefin wax and 2,9-dimethyl quinacridone, with a styrene resin or styrene-acrylic copolymer resin, is dispersed in a binder resin (biding resin) made of a polyester resin.

An example of this kind is toner which uses a quinacridone type pigment that is known as a magenta pigment having excellent color hue, and such toner is expected to display excellent offset resistance (fixing properties) and resistance to wrapping (separability).

Furthermore, a second example is a red toner including a binding resin, a colorant, and a releasant, the toner containing a polyester resin as the main component of the binding resin, containing a naphthol AS pigment as the colorant, and containing an ester wax, such as carnauba wax, as the releasant.

The toner according to this example incorporates carnauba wax, which is known as a wax having excellent toner storage stability (resistance to bleeding), fixing properties, and resistance to adhesion, and such toner can be expected to show excellent color hue and make it possible to maintain stable image quality.

SUMMARY OF THE INVENTION

It is an object of the present invention to provide a toner set comprising toners of a plurality of colors, having excellent toner storage stability, fixing properties, separability and resistance to adhesion. It is a further object of the present invention to provide a developer set comprising a plurality of developers each containing a respective toner of the toner set and a carrier, an image forming apparatus which uses the developers of the developer set, and an image forming apparatus which uses the developers of the developer set.

One aspect of the present invention which achieves this object is a toner set comprising a plurality of toners used in an image forming method for forming an image by forming a toner image composed of toners of a plurality of colors and fixing the toner image thus formed onto a recording medium, wherein the toners of a plurality of colors comprise a first toner and a second toner of a different color from the first toner; the first toner and the second toner respectively contain toner base particles including a binding resin, a colorant and a wax, the colorant of the first toner contains a quinacridone pigment; the wax includes a carnauba wax and a wax other than the carnauba wax; the toner base particles of the first toner have a mass % $W_{q1}$ of carnauba wax and $W_{o1}$ of the other wax and the toner base particles of the second toner have a mass % $W_{q2}$ of carnauba wax and $W_{o2}$ of the other wax and these mass % values are selected to satisfy Formula (1) and Formula (2) below:

$$W_{q1}/(W_{q1}+W_{q2})<W_{o1}/(W_{o1}+W_{o2}) \quad (1)$$

$$3\leqq W_{o1}+W_{o2}<W_{q1}+W_{q2}\leqq 10 \quad (2).$$

Moreover, a further aspect of the present invention is a developer set, comprising developers of a plurality of colors, wherein the developers of a plurality of colors comprise a developer containing a first toner of the toner set and a carrier, and a developer containing a second toner of the toner set and a carrier.

Moreover, a further aspect of the present invention is an image forming apparatus, comprising: a plurality of image bearing members arranged in parallel in a prescribed direction in order to form toner images using toners of different colors on the surfaces thereof; and a plurality of developing devices which are disposed facing the respective image bearing members and supply toners contained in developers to the surfaces of the respective image bearing members, wherein the developers used in the plurality of developing devices are the respective developers of the developer set.

Moreover, a further aspect of the present invention is an image forming method, comprising the step of: forming toner images using toners of different colors on the surfaces of a plurality of image bearing members arranged in parallel in a prescribed direction, by supplying, to the surfaces of the respective image bearing members, toners contained in developers accommodated in a plurality of developing devices disposed facing the image bearing members, respectively, wherein the respective developers of the developer set are used as the developers accommodated in the plurality of developing devices.

BRIEF DESCRIPTION OF THE DRAWINGS

FIG. 1 is a schematic cross-sectional diagram showing the general composition of an image forming apparatus used in the present embodiment.

DETAILED DESCRIPTION OF THE PREFERRED EMBODIMENTS toner used in an image forming apparatus is required to have good storage stability, fixing properties, separability, resistance to adhesion, and so on. Good storage stability of the toner means that even if the toner is stored at a relatively high temperature, for example, there is no degradation of the toner, for instance, little bleeding of the incorporated wax. Good fixing properties mean that when a toner image formed on the recording medium is fixed by a fixing roller, the toner image is fixed satisfactorily to the recording medium. Good separability means that the recording medium after fixing is not liable to adhere to the fixing roller and the recording medium and the fixing roller separate from each other satisfactorily, in other words, there is little occurrence of jams due to the recording medium wrapping about the fixing roller. Furthermore, good resistance to adhesion means that little toner remains on the surface of photoconductor after image formation, and there is little occurrence of so-called "filming".

According to investigations carried out by the present inventors, there has been a problem in that when high-speed printing or low-temperature fixing, or the like, is carried out using color toner such as that in the first example, the fixing properties and separability are insufficient.

Furthermore, if an image is formed using toner incorporating only a carnauba wax as a wax (releasant) as in the case of the second embodiment, then the fixing properties and the separability tend to decline. This is thought to be because the carnauba wax incorporated into the toner has excessively high miscibility with the binding resin, such as polyester resin. In other words, if the miscibility between the wax and the binding resin is too high, then it is thought that the wax becomes excessively dispersed in the binding resin and there is insufficient bleeding out of the wax. It is considered that the fixing properties and separability decline for this reason. Moreover, if magenta toner is formed by using a quinacridone pigment as a magenta pigment, instead of a naphthol AS pigment, then if high-speed printing is carried out, for instance, there is a problem in that the fixing properties and the separability decline further.

This problem of decline in the fixing properties and separability, and the like, tends to become especially marked in cases where the toner is used in an image forming apparatus which forms an image by forming a toner image composed of toners of a plurality of colors and fixing the toner image thus formed on a recording medium, for example, a color image forming apparatus, or the like, based on a tandem system.

Furthermore, the present inventors surmised that if a quinacridone pigment is used as a colorant and only carnauba wax is used as a wax, then the reason for the decline in the fixing properties is because the carnauba wax becomes incorporated into the quinacridone pigment and the dispersion of the wax into the binding resin becomes even higher, in other words, the wax is dispersed finely in the binding resin.

On the other hand, the present inventors discovered that if only wax other than carnauba wax is used as the wax, then the resistance to adhesion to the developing roller and photoconductor declines dramatically. This is thought to be because the miscibility of the binding resin and the wax declines excessively, and the wax bleeds out from toner base particles and separates.

Therefore, the present inventors arrived at the idea of combining the use of carnauba wax and a wax other than carnauba wax, as the wax. In so doing, it is considered that the dispersibility of the wax in the binding resin is reduced to a suitable degree, the wax domain diameter is increased to a certain size, and consequently, the fixing properties and the separability can be improved by maintaining good resistance to adhesion.

Moreover, if the toner is used in an image forming method which forms an image by forming a toner image composed of toners of a plurality of colors and fixing the toner image thus formed on the recording medium, then further decline in the fixing properties results, and the like, and although this can be improved to some extent by adjusting the fixing conditions, such as the fixing temperature, when forming an image by using toner of a single color, it is considered to be difficult to set suitable fixing conditions, and the like, for the toners of all colors when fixing a toner image composed of toners of a plurality of colors. In other words, it is thought that if the fixing conditions, and the like, are adjusted to suit the fixing properties of magenta toner containing quinacridone pigment, for example, then the fixing properties of the other toner become worse, and furthermore, if the fixing conditions, and the like, are adjusted to suit the fixing properties of the other toner, then the fixing properties of the magenta toner containing quinacridone pigment become worse. Due to these factors, it is considered difficult to achieve a balance of fixing properties.

The present inventors concentrated on achieving excellent fixing properties, and the like, in each toner and also on balancing the fixing properties between the toners, and arrived at the present invention as described below which combines the use of a carnauba wax and another wax apart from carnauba wax, and specifies the wax content in each toner.

Embodiments of the present invention relating to the present invention are described below, but the present invention is not limited to these.

[Toner Set]

The toner set relating to the present embodiment is a toner set comprising a plurality of toners which are used in an image forming method for forming an image by forming a toner image composed of toners of a plurality of colors and fixing the toner image thus formed onto a recording medium.

This toner set comprises at least a first toner and a second toner of a different color from the first toner. The first toner and the second toner respectively contain toner base particles including a binding resin, a colorant and a wax. The colorant of the first toner contains a quinacridone pigment. In other words, the first toner is magenta toner.

The wax contains a carnauba wax and a wax other than the carnauba wax, and when the contents of the carnauba wax in the first toner, the other wax in the first toner, the carnauba wax in the second toner, and the other wax in the second toner in the toner base particles of the respective toners, are respectively $W_{q1}$ mass %, $W_{q2}$ mass %, $W_{o1}$ mass %, and $W_{o2}$ mass %, Formula (1) and Formula (2) below are satisfied:

$$W_{q1}/(W_{q1}+W_{q2})<W_{o1}/(W_{o1}+W_{o2}) \quad (1)$$

$$3\leqq W_{o1}+W_{o2}<W_{q1}+W_{q2}\leqq 10 \quad (2).$$

Desirably, Formula (3) below is satisfied. More specifically, desirably, Formula (1) above and Formula (3) below are satisfied.

$$4\leqq W_{o1}+W_{o2}<W_{q1}+W_{q2}\leqq 8 \quad (3)$$

<First Toner (Magenta Toner)>

As described above, the first toner contains toner base particles including a binding resin, a colorant and wax.

(Binding Resin)

There are no particular restrictions on the binding resin that can be used, provided that the resin is one used conventionally as a binding resin for toner base particles. More specifically, for example, the binding resin may be a styrene resin, an acrylic resin, a styrene-acrylic copolymer, a polyethylene resin, a polypropylene resin, a vinyl chloride resin, a polyester resin, a polyamide resin, a polyurethane resin, a polyvinyl alcohol resin, a vinyl ether resin, an N-vinyl resin, a styrene-butadiene resin, or the like. Of these, a polyester resin is desirable due to having excellent low-temperature fixing properties and a broad non-offset temperature range. Furthermore, the respective binding resins may be used individually or a combination of two or more types of the resins may be used as the binding resin.

The polyester resin stated above may be, for example, one obtained by condensation polymerization or co-condensation polymerization of an alcohol component and a carboxylic acid component. Furthermore, the following substances may be cited as examples of the component used to synthesize the polyester resin.

There are no particular restrictions on the alcohol component, provided that it can be used as an alcohol for synthesizing a polyester resin. Furthermore, it is necessary that the alcohol component should contain an alcohol having two or more hydroxy groups in each molecule (dihydric or higher polyhydoric alcohol). Possible examples of an alcohol component which may be used include: dihydric alcohols, specific examples of which are diols, such as ethylene glycol, diethylene glycol, triethylene glycol, 1,2-propylene glycol, 1,3-propylene glycol, 1,4-butane diol, neopentyl glycol, 1,4-butene diol, 1,5-pentane diol, 1,6-hexane diol, 1,4-cyclohexane dimethanol, dipropylene glycol, polyethylene glycol, polypropylene glycol, polytetramethylene glycol, or the like; or bisphenols, such as bisphenol A, hydrogenated bisphenol A, polyoxyethyleneated bisphenol A, polyoxypropyleneated bisphenol A, or the like. Further possible examples of substances which can be used as the alcohol component are trihydric or higher polyhydric alcohols, more specifically, for instance, sorbitol, 1,2,3,6-hexane tetrol, 1,4-sorbitan, pentaerythritol, dipentaerythritol, tripentaerythritol, 1,2,4-butane triol, 1,2,5-pentane triol, glycerol, diglycerol, 2-methyl propane triol, 2-methyl-1,2,4-butane triol, trimethylol ethane, trimethylol propane, 1,3,5-trihydroxy methyl benzene, or the like. Furthermore, the respective alcohol components may be used individually or a combination of alcohol components of two or more types may be used.

Furthermore, there are no particular restrictions on the carboxylic acid component, provided that it can be used as a carboxylic acid for synthesizing a polyester resin. Moreover, the carboxylic acid component may also include, as well as carboxylic acid, an acid anhydride or a lower alkyl ester, or the like, of carboxylic acid. The carboxylic acid component needs to include two or more hydroxy groups in the molecule of the carboxylic acid (dicarboxylic or higher polycarboxylic acid). Of the substances that can be used as the carboxylic acid, it is possible to cite dicarboxylic acids, for instance, of which specific examples are: maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkyl succinic acid, and alkenyl succinic acid, and the like. Possible examples of an alkyl succinic acid are, for instance: n-butyl succinic acid, n-octyl succinic acid, n-dodecyl succinic acid, isododecyl succinic acid, or the like; and possible examples of an alkenyl succinic acid are for instance: n-butenyl succinic acid, isobutyl succinic acid, isobutenyl succinic acid, n-octenyl succinic acid, n-dodecenyl succinic acid, isododecenyl succinic acid, or the like. Furthermore, specific examples of tricarboxylic or higher polycarboxylic acids which can be used as the carboxylic acid are, for instance: 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra(methylene carboxyl) methane, 1,2,7,8-octane tetracarboxylic acid, pyromellitic acid, enpol trimer acid, or the like. Furthermore, the respective carboxylic acid components may be used individually or a combination of carboxylic acid components of two or more types may be used.

From the viewpoint of fixing properties, desirably, a thermoplastic resin as described above is used for the binding resin, but the resin does not need to be thermoplastic resin only and it is possible to use the thermoplastic resin in combination with a crosslinking agent or a thermocurable resin. By introducing a partially crosslinked structure in the binding resin in this way, it is possible to improve the storage stability, shape retention and durability of the toner, and the like, while suppressing decline in the fixing properties.

(Colorant)

There are no particular restrictions on the colorant, provided that it contains a quinacridone pigment, as described above. More specifically, it is also possible to contain a colorant other than quinacridone pigment, but it is desirable that the colorant contained in the magenta toner is one composed of quinacridone pigment only.

The quinacridone pigment has excellent color hue and is known to be suitable as a colorant for magenta toner, but in general, when a toner set comprising magenta toner using a quinacridone pigment only as a colorant is employed, there has been a tendency for the fixing properties and separability to decline when high-speed printing or the like is carried out. Nevertheless, in the toner set relating to the present embodiment, even if magenta toner using only a quinacridone pigment is provided, a toner set having excellent fixing properties and separability, and the like, can be obtained. Consequently, even if magenta toner using a quinacridone pigment only is provided, the decline in the fixing properties and separability, and the like, is suppressed adequately, and furthermore, since the quinacridone pigment is suitable as a colorant for magenta toner, then it is desirable to use only a quinacridone pigment as a colorant contained in the magenta toner.

Furthermore, there are no particular restrictions on the quinacridone pigment, providing that it is a quinacridone or a derivative of quinacridone. A more specific example is a substance containing a compound represented by the General Formula (4) below, for example.

[Chemical Formula 1]

(4)

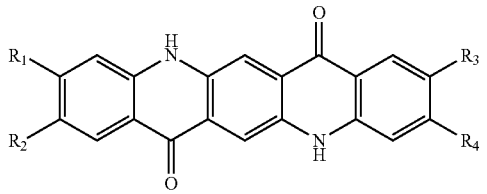

(In General Formula (4), $R_1$ to $R_4$ respectively and independently indicate a hydrogen atom, an alkyl group, an alkoxyl group and a halogen atom).

Furthermore, even if the toner contains a color material other than a quinacridone pigment, it is desirable that the quinacridone pigment should be at least 10 parts by mass or more with respect to 100 parts by mass of the whole colorant. If a colorant other than a quinacridone pigment is contained in the toner, there are no particular restrictions on the colorant other than quinacridone pigment, and possible examples are commonly known pigments, dyes, or the like.

In order to attain suitable image density, the added amount of colorant is generally 1 to 10 parts by mass and desirably 3 to 8 parts by mass with respect to 100 parts by mass of the binding resin.

(Wax)

Carnauba wax and a wax other than carnauba wax are included as the wax. In so doing, it is considered that suitable dispersibility of the wax in the binding resin is achieved and the fixing properties and dispersibility can be improved while maintaining good resistance to adhesion.

Moreover, when the contents of the carnauba wax in the first toner, the other wax in the first toner, the carnauba wax in the second toner, and the other wax in the second toner in the toner base particles of the respective toners, are respectively $W_{q1}$ mass %, $W_{q2}$ mass %, $W_{o1}$ mass %, and $W_{o2}$ mass %, Formula (1) and Formula (2) below are satisfied:

$$W_{q1}/(W_{q1}+W_{q2})<W_{o1}/(W_{o1}+W_{o2}) \quad (1)$$

$$3\leqq W_{o1}+W_{o2}<W_{q1}+W_{q2}\leqq 10 \quad (2).$$

In so doing, it is considered that good toner stability can be ensured while achieving good fixing properties, separability and resistance to adhesion.

If Formula (1) described above is not satisfied, then it is difficult to achieve a good balance between the fixing properties of the first toner and the second toner, and even if the fixing conditions, such as the fixing temperature and the like are adjusted, there is tendency for at least one of the fixing properties of the first toner and the second toner to decline.

Furthermore, the total amount of the carnauba wax and the other wax in the first toner and the second toner (total amount of wax) must satisfy Formula (2) stated above, and desirably, also satisfies Formula (3) stated below.

$$4\leqq W_{o1}+W_{o2}<W_{q1}+W_{q2}<8 \quad (3)$$

Furthermore, if the total amount of wax is too small, then the beneficial effects of the wax are not obtained satisfactorily, and there is a tendency for the fixing properties to decline. Furthermore, if the amount of wax is too great, the resistance to blocking declines, separation of the wax from the toner occurs, and therefore the storage stability of the toner tends to decline. If the toner stability is poor, then when carrying out constant printing, or the like, which involves printing continuously for a long period of time, for example, the wax in the toner is transferred to the carrier and there is a risk that decline in the developing properties, or the like, will occur due to charging defects. Furthermore, if the total amount of wax in the first toner is smaller than the total amount of wax in the second toner, then it tends to become impossible to ensure good fixing properties.

Moreover, there are no particular restrictions on the other wax used, provided that it is a wax used conventionally as a wax of toner base particles. Specific examples thereof include, for instance: a synthetic ester wax made of polyhydric alcohol and carboxylic acid; a synthetic hydrocarbon wax, such as a Fischer-Tropsch (hereinafter, abbreviated to "FT") wax, a polyethylene wax, or a polypropylene wax; a vegetable wax, such as sugar cane wax or tree wax; or animal waxes, such as beeswax, insect wax, whale wax, lanolin, or the like. Of these, synthetic ester wax is desirable due to having excellent dispersibility in the binding resin.

Furthermore, the synthetic ester wax is made of a polyhydric alcohol and carboxylic acid. Possible examples of a polyhydric alcohol are, for instance, pentaerythritol, lauryl alcohol and myristyl alcohol, and the like. Furthermore, possible examples of the carboxylic acid are, for instance, behenic acid, capric acid, lauric acid, acetic acid, or the like. Of these, pentaerythritol tetrabehenate composed of pentaerythritol and behenic acid, for example, is especially desirable as the synthetic ester wax due to having desired appropriate heat characteristics with respect to the toner adherence properties.

(Charge Control Agent)

In order to improve charging properties, and the like, the toner base particles generally contain a charge control agent. There are no particular restrictions on the charge control agent that can be used, provided that it is one used conventionally as a charge control agent in toner base particles. Concrete examples thereof are, for instance: a charge control agent displaying positive charging properties, such as a nigrosine compound, a quaternary ammonium salt compound, a resin-type charge control agent in which an amine compound is combined with a resin, or a charge control resin, or the like. Furthermore, desirably the added amount of the charge control agent is 0.5 to 20 parts by mass, and more desirably, 1 to 5 parts by mass, with respect to 100 parts by mass of the binding resin. If the added amount of the charge control agent is too small, then it is difficult to charge the toner stably to a prescribed polarity, and there is a tendency for fogging to occur. Furthermore, if the added amount of the charge control agent is too great, then environmental tolerance declines, and in particular charging errors and image defects occur in high-temperature and high-humidity conditions, and there is a tendency for problems, such as soiling of the photoconductor, to occur readily.

(Method of Manufacture)

There are no particular restrictions on the method of manufacturing the toner base particles, but they can be manufactured as described below, for instance.

Firstly, the respective components of the toner base particles, such as the binding resin and colorant described above are mixed together in a mixer, or the like. A commonly known mixer may be used, for instance, a Henschel type mixer, such as a Henschel mixer, a super mixer, or a Mechanomill, or an Ongumill, a hybridization system, a Cosmosystem, or the like.

Next, the mixed material thus obtained is melted and kneaded with a kneader, or the like. It is possible to use a commonly known kneading machine, for instance, a twin-screw extruder, a triple-roll mill, a laboblast mill, or the like, and the twin-screw extruder is desirable. Furthermore, a temperature at the time of melting and kneading is preferably equal to or above the softening temperature of the binding resin and below the decomposition temperature of the binding resin.

Thereupon, the melted and kneaded material thus obtained is cooled and solidified, and this solid material is then pulverized in a crusher, or the like. A commonly known crusher can be used, for example, a feather mill, or the like.

Finally, the obtained pulverized material is sorted by a classifier, or the like. The sorting process is able to remove excessively crushed material or coarse particles, and thus makes it possible to obtain desired toner base particles. A commonly known classifier can be used, for example, an elbow jet, or the like.

<External Additive>

The first toner may be made of only the toner base particles described above, for example, provided that it contains toner base particles in which the wax content satisfies Formula (1) and Formula (2) given above, and the first toner may also be obtained by adding an external additive to the toner base particles. In other words, if the toner is one obtained by adding an external additive to the toner base particles, then the toner base particles are subjected to an external addition step.

There are no particular restrictions on the external addition step used, provided that a commonly known method is used. More specifically, for example, by adding an external additive to the toner base particles and churning in a churning machine, or the like, the external additive is caused to adhere to or fix to the surfaces of the toner base particles.

There are no particular restrictions on the external additive, provided that it can be used as an external additive for toner. More specific examples are, for instance, inorganic oxides, such as silica, titanium oxide, alumina, or the like, or a metallic soap, such as calcium stearate, or the like. Of these, silica particles or titanium oxide particles are desirable due to having excellent fluidity, charging properties and polishing properties, and combined use of silica particles and titanium oxide particles is more desirable. Furthermore, the external additive described above may be used individually or a combination of two or more types of the external additive can be used.

Moreover, desirably, the content of the external additive is 0.2 to 3 parts by mass with respect to 100 parts by mass of the toner base particles.

With regard to the churning machine, it is possible to use a conventionally known churning machine, without any restrictions. Specific examples include common churning machines, such as a tandem churning machine, a Henschel mixer, a super mixer, or the like.

<Second Toner (Toner Other than Magenta Toner)>

As described above, the second toner contains toner base particles including a binding resin, a colorant and wax.

(Binding Resin)

There are no particular restrictions on the binding resin that can be used, provided that the resin is one used conventionally as a binding resin for toner base particles. More specifically, for instance, a similar binding resin to that of the first toner can be cited as an example. The content of this binding resin is similar to that of the first toner.

(Colorant)

For the colorant, it is possible to use a commonly known pigment or dye in such a manner that a desired color is obtained in the toner. More specific examples are colorants such as the following, depending on the color. Possible examples of a black pigment are: acetylene black, lamp black, aniline black, or another carbon black. Possible examples of a yellow pigment are: chrome yellow, zinc yellow, cadmium yellow, yellow iron oxide, mineral fast yellow, nickel titanium yellow, Naples yellow, naphthol yellow S, Hansa yellow G, Hansa yellow 10G, benzidine yellow G, benzidine yellow GR, lake quinoline yellow, permanent yellow NCG, tartrazine lake, C.I. Pigment Yellow 180, or the like. Possible examples of an orange pigment are: chrome orange, molybdenum orange, permanent orange GTR, pyrazolone orange, Balkan orange, indanthrene brilliant orange RK, benzidine orange G, indanthrene brilliant orange GK, and the like. Possible example of a red pigment are: red iron oxide, cadmium red, red lead, cadmium mercury sulfide, permanent red 4R, lithol red, pyrazolone red, watching red calcium salt, lake red D, brilliant carmine 6B, eosine lake, rhodamine lake B, alizarin lake, brilliant carmine 3B, C.I. Pigment Red 238, and the like. Possible examples of a violet pigment are: manganese violet, fast violet B, methyl violet lake, and the like. Possible examples of a blue pigment are: iron blue, cobalt blue, alkali blue lake, Victoria blue lake, phthalocyanine blue, metal-free phthalocyanine blue, partially chlorinated phthalocyanine blue, fast sky blue, indanthrene blue BC, C.I. Pigment Blue 15-3, and the like. Possible examples of a green pigment are: chrome green, chromium oxide, Pigment Green B, malachite green lake, final yellow green G, and the like. Possible examples of a white pigment are: zinc white, titanium oxide, antimony white, zinc sulfide, barite powder, barium carbonate, clay, silica, white carbon, talc, alumina white, and the like.

More specifically, if the second toner is cyan toner, for instance, then a possible example is a phthalocyanine pigment, such as C.I. Pigment Blue 15-3, or the like. The content is also similar to that of the first toner.

(Wax)

Similarly to the wax in the first toner, carnauba wax and a wax other than carnauba wax are included as the wax. The content of wax satisfies Formula (1) and Formula (2) stated above.

(Charge Control Agent)

There are no particular restrictions on the charge control agent that can be used, provided that it is one used conventionally as a charge control agent in toner base particles. More specifically, for instance, a similar charge control agent to that of the first toner can be cited as an example. The content of this binding resin is similar to that of the first toner.

(Method of Manufacture)

There are no particular restrictions on the method of manufacturing the toner base particles. More specifically, the toner base particles of the second toner can be manufactured in a similar fashion to the toner base particles of the first toner.

<External Additive>

The second toner may be made of only the toner base particles described above, for example, provided that it contains toner base particles in which the wax content satisfies Formula (1) and Formula (2) given above, and the first toner may also be obtained by adding an external additive to the toner base particles. In other words, if the toner is one obtained by adding an external additive to the toner base particles, then the toner base particles are subjected to an external addition step.

There are no particular restrictions on the external addition step or the external additive, provided that the addition step and the external additive are commonly known in the prior art. More specifically, for instance, a similar step and additive to those of the first toner can be cited as examples. The content thereof is similar to that of the first toner.

The second toner has no particular relation to the color of the first toner, but desirably when carrying out the toner image formation, the second toner is toner used immediately before or immediately after the first toner is used. In so doing, better balance of fixing properties is obtained between the first toner and the second toner, and hence each of the toners is able to display more satisfactory fixing properties.

[Developer Set]

A developer set including the respective toners of the toner set comprises developers of a plurality of colors. The developers of a plurality of colors may each be one-component developers which contain respective toners of the toner set and do not contain a carrier, or may be two-component carriers which contain both a toner and a carrier; the use of two-component developers is desirable. In the case of a two-component developer, the developer set comprises, at the least, a develop containing the first toner and a carrier, and a developer containing the second toner and a carrier, for example. Here, a developer set comprising two-component developers of a plurality of colors will be described. The developer set relating to the present embodiment comprises developers of a plurality of colors, and the developers of a plurality of colors each contain a respective toner of the toner set and a carrier.

(Carrier)

There are no particular restrictions on the carrier, provided that the carrier is one used as a carrier in a developer. More specific examples of the carrier are, for instance, a ferrite carrier, or a carrier formed by coating resin onto the surface of magnetic particles, which is a carrier core material. The carrier core material may be, for example, magnetic particles manufactured by sintering and atomizing, or otherwise processing, a magnetic metal, such as iron, nickel or cobalt, an alloy of these, an alloy containing a rare earth element, hematite, magnetite, a manganese-zinc ferrite, a nickel-zinc ferrite, a manganese-magnesium ferrite, a lithium ferrite, or other soft ferrites, or an iron oxide such as a copper-zinc ferrite, a combination of these, or another magnetic material.

Possible examples of a surface coating agent which coats the surface of the carrier core material obtained as described above include fluorine binding resins, such as polytetrafluoroethylene, polychlorotrifluoroethylene, vinylidene polyfluoride, or the like.

The particle size of the carrier is generally represented by the particle size obtained by an electron microscope and desirably is in the range of 20 to 200 μm, and more desirably, the range of 30 to 150 μm. If the main component of the carrier is magnetic material, then the apparent density of the carrier varies with the composition of the magnetic body and the surface structure, and other factors, but generally it is desirable that the apparent density of the carrier should be in the range of 3000 to 8000 kg/m$^3$.

The toner concentration in the two-component developer including the toner and the carrier is 1 to 20 mass %. Desirably, the toner concentration is 3 to 15 mass %. If the toner concentration is less than 1 mass %, then the image density becomes too thin. On the other hand, if the toner concentration exceeds mass %, then toner scattering occurs inside the developing device, and there is a risk of problems such as soiling of the interior of the apparatus and adherence of toner to the background portions of the transfer paper, and the like.

The developers of the developer set according to the present embodiment are two-component developers in which the toner and the carrier described above are combined in a suitable ratio, and these developers can be used in the image forming apparatus described below, for example.

[Image Forming Apparatus and Image Forming Method]

The image forming apparatus which uses the toner set and the developer set is an electrophotographic type of image forming apparatus and is not limited in particular provided that the apparatus uses toners and developers of a plurality of colors in the image forming operation. A more specific example is a tandem-system color image forming apparatus using toners of a plurality of colors, as described below. Here, a tandem-system color image forming apparatus will be described. The image forming apparatus relating to the present embodiment comprises a plurality of image bearing members arranged in parallel in a prescribed direction in order to form toner images using toners of different colors onto the surfaces thereof, and a plurality of developing devices which are disposed facing the respective image bearing members and supply toners contained in developers to the surfaces of the respective image bearing members, and the developers used in the plurality of developing devices are the respective developers of the developer set described above.

Furthermore, an image forming method which uses the toner set and the developer set is an electrophotographic type of image forming method and is not limited in particular provided that the method uses toners and developers of a plurality of colors in the image forming operation. A more specific example is an image forming method which employs a tandem-system color image forming apparatus using toners of a plurality of colors, as described below. The image forming method relating to the present embodiment comprises a step of forming toner images using toners of different colors, onto the surfaces of image bearing members, by supplying, to the surfaces of the respective image bearing members, toners contained in respective developers accommodated in a plurality of developing devices arranged facing each one of a plurality of image bearing members which are disposed in parallel in a prescribed direction; and the image forming method uses the respective developers of the developer set described above as the developers which are accommodated in the plurality of developing devices.

FIG. 1 is a schematic cross-sectional diagram showing the general composition of an image forming apparatus 1. Here, a color printer 1 is described as an example of an image forming apparatus 1.

As shown in FIG. 1, the color printer 1 has a box-shaped apparatus main body 1*a*. Inside the apparatus main body 1*a* are provided: a paper supply unit 2 which supplies paper P, an image forming section 3 which transfers an image onto paper P while conveying paper P supplied from the paper supply unit 2, and a fixing unit 4 which carries out a fixing process on an image that has been transferred to the paper P by the image forming section 3. Moreover, a paper output unit 5 from which paper P that has undergone a fixing process by the fixing unit 4 is output is provided on the upper face of the apparatus main body 1*a*.

The paper supply unit 2 comprises a paper supply cassette 21, a pick-up roller 22, paper supply rollers 23, 24, 25 and a pair of resist rollers 26. The paper supply cassette 21 is provided detachably with respect to the apparatus main body 1*a* and stores papers P of various sizes. The pick-up roller 22 is provided in an upper right-hand position (in FIG. 1) of the paper supply cassette 21 and pays out sheets of paper P stored in the paper supply cassette 21, one sheet at a time. The paper supply rollers 23, 24, 25 convey the paper P paid out by the pick-up roller 22, along a paper conveyance path. The pair of resist rollers 26 cause the paper to halt temporarily after being conveyed along the paper conveyance path by the paper supply rollers 23, 24, 25, and then supply the paper P to the image forming section 3 at a prescribed timing.

Furthermore, the paper supply unit 2 also comprises a manual feed tray and a pick-up roller 27 (not illustrated) which are installed on the right-hand face of the apparatus main body 1*a* as shown in FIG. 1. This pick-up roller 27 pays out paper P which has been placed on the manual feed tray. The paper P taken up by the pick-up roller 27 is conveyed along the paper conveyance path by the paper supply rollers 23 and 25, and is supplied to the image forming section 3 at a prescribed timing by the pair of resist rollers 26.

The image forming section 3 comprises: an image forming unit 7, an intermediate transfer body 11 onto the surface (contact surface) of which a toner image is primarily transferred by the image forming unit 7, and a secondary transfer roller 12 for secondarily transferring the toner image on the intermediate transfer body 11 to paper P supplied from the paper supply cassette 21.

The image forming unit 7 comprises a black unit 7K, a yellow unit 7Y, a cyan unit 7C and a magenta unit 7M, which are arranged successively from the upstream side (the left-hand side in FIG. 1) to the downstream side. In each of the respective units 7K, 7Y, 7C and 7M, a photoconductive drum 71 constituting an image bearing members is arranged rotatably in the direction of the arrow (counter-clockwise direction) in a central position of the unit. A charger 75, an exposure device 76, a developing device 72, a cleaner 73 and a charge neutralizer 74, and the like are disposed respectively in sequence from the upstream side of the direction of rotation, about the periphery of each of the photoconductive drums 71. The photoconductive drum 71 is, for example, an amorphous silicone photoconductor having a photoconductive layer containing amorphous silicone, or the like.

The charger 75 uniformly charges the circumferential surface of the photoconductive drum 71 which rotates in the direction of the arrow. The charger 75 may be, for example, a charger provided with a charging roller, or a scorotron charger.

The exposure device 76 is a so-called laser scanning unit, which irradiates laser light on the basis of image data input from an image reader, or the like, onto the circumferential surface of the photoconductive drum 71 which has been charged uniformly by the charger 75, thereby forming an electrostatic latent image based on the image data on the photoconductive drum 71.

The developing device 72 comprises a developer accommodating unit which accommodates developer. The developing device 72 forms a toner image based on the image data by supplying the toner of the developer accommodated in the developer accommodating unit, to the circumferential surface of the photoconductive drum 71 on which the electrostatic latent image has been formed. This toner image is transferred primarily to the intermediate transfer body 11. In each of the image forming units a developer comprising toner of a different color is accommodated in the developer accommodating unit of the developing device 72.

The cleaner 73 cleans away the toner remaining on the circumferential surface of the photoconductive drum 71 after primary transfer of the toner image onto the intermediate transfer body 11 has been completed. The charge neutralizer 74 electrically neutralizes the circumferential surface of the photoconductive drum 71 after the completion of primary transfer. The circumferential surface of the photoconductive drum 71 which has been cleaned by the cleaner 73 and the charge neutralizer 74 then comes to face the charger 75 for a new charging process, in preparation for a new image forming operation.

The intermediate transfer belt 11 is an endless belt-shaped rotating body, which is spanned about a plurality of rollers, namely, a drive roller 13, a belt supporting roller 14, a back-up roller 15 and a primary transfer roller 16, in such a manner that the surface (contact surface) thereof abuts respectively at the circumferential surfaces of the photoconductive drums 71. Moreover, the intermediate transfer belt 11 is composed so as to rotate endlessly by means of the plurality of rollers, in a state of being pressed against the photoconductive drums 71 by the primary transfer rollers 16 which are disposed opposing the respective photoconductive drums 71.

The drive roller 13 is driven to rotate by a drive source, such as a stepping motor, and supplies drive force for endlessly rotating the intermediate transfer belt 11. The belt supporting roller 14 and the back-up roller 15 are idle rollers which are provided rotatably and rotate with the endless rotation of the intermediate transfer belt 11 caused by the drive roller 13. These idle rollers 14, 15 rotate passively via the intermediate transfer belt 11 in accordance with the principal rotation of the drive roller 13, as well as supporting the intermediate transfer belt 11.

The primary transfer roller 16 applies a primary transfer bias (of reverse polarity to the charging polarity of the toner) to the intermediate transfer belt 11. In so doing, the toner images formed on the photoconductive drums 71 are transferred successively (primary transfer) in a mutually superimposed fashion onto the intermediate transfer belt 11 which rotates in the direction of the arrow (clockwise direction) due to the driving of the drive roller 13, between the photoconductive drums 71 and the primary transfer rollers 16. The primary transfer rollers 16 rotate by receiving a drive force from a drive motor which turns the photoconductive drums 71.

The secondary transfer roller 12 applies a secondary transfer bias of opposite polarity to the toner image, to the paper P. In so doing, the toner image which has been primarily transferred onto the intermediate transfer belt 11 is transferred onto the paper P between the secondary transfer roller 12 and the back-up roller 15, whereby a color transfer image is formed on the paper P.

The fixing unit 4 carries out a fixing process on the transfer image which is transferred to the paper P in the image forming section 3, and comprises a heating roller 41 which is heated by an electrical heater and, disposed facing this heating roller 41, a pressurizing roller 42, the circumferential surface of which abuts against and presses the circumferential surface of the heating roller 41.

The transfer image which is transferred to the paper P by the secondary transfer roller 12 in the image forming section 3 is fixed onto the paper P by a fixing process of applying heat when the paper P passes between the heating roller 41 and the pressurizing roller 42. The paper P which has undergone a fixing process is output to the paper output unit 5. Furthermore, in the color printer 1, a conveyance roller 6 is provided at a suitable location between the fixing unit 4 and the paper output unit 5.

By means of the image forming operation described above, an image is formed on the paper P by the image forming apparatus 1. In a tandem-system image forming apparatus such as that described above, developer containing the first toner (magenta toner) of the developer set described above is supplied to the developing device of the magenta unit 7M, and developer containing the second toner is supplied to the developing devices 72 of the other units 7. In so doing, a good balance between the fixing properties of the first toner and the second toner is achieved and an image of high quality can be formed. Furthermore, since the first toner and the second toner respectively have excellent storage stability, fixing properties, separability and resistance to adhesion, then it is possible, for example, to carry out image formation while suppressing the incidence of jams caused by paper wrapping about the fixing roller.

PRACTICAL EXAMPLES

The present invention is described in more concrete terms below on the basis of practical examples. The present invention is not limited by these examples.

Practical Example 1

(Magenta Toner: Manufacture of First Toner)

Firstly, the following were mixed in a Henschel mixer (made by Nippon Coke and Engineering Co., Ltd.): 100 parts by mass of polyester resin (Armatex P645 made by Mitsui Chemical Co., Ltd.), as a binding resin, 5 parts by mass of quinacridone pigment (Paliogen Pink L 4790 made by BASF), as a colorant, 2 parts by mass of carnauba wax (made by Toa Chemical Co., Ltd.) and 4 parts by mass of synthetic ester wax (WEP-5 made by NOF Corp., a pentaerythritol tetrabehenate composed of pentaerythritol and behenic acid), as waxes, and 10 parts by mass of charge control resin (FCA-1001-NG made by Fujikura Kasei Co., Ltd.), as a charge control agent. Thereupon, the mixture thus obtained was melted and kneaded in a twin-axle extruder (PCM-30 made by Ikegai Co., Ltd.), and the kneaded material thus produced was cooled to form chips, using a drum flaker (a belt drum flaker made by Nippon Coke and Engineering Co., Ltd.). The kneaded material that had cooled in the form of chips was crushed roughly in a feather mill (a 350×600 model made by Hosokawa Micron Co., Ltd) and then crushed finely in a pneumatic pulverizer (an IDS-2 jet mill made by Nippon Pneumatic Manufacturing Co., Ltd.), before being classified by an elbow joint classifier (EJ-LABO made by Nittetsu Mining Co., Ltd.). In so doing, toner base particles having a volume-average particle size of 8 μm were obtained. The volume-average particle size of the toner base particles was measured by a particle analyzer (Multisizer 3 manufactured by Beckman Coulter).

Next, one part by mass of silica particles (HVK-2150 made by Wacker Chemie) and one part by mass of titanium oxide particles (STT-65C made by Titan Kogyo, Co., Ltd.) were added as external additives to 100 parts by mass of the toner base particles thus obtained, and mixing was carried out in a Henschel mixer (made by Nippon Coke and Engineering Co., Ltd.). In this way, magenta toner (toner base particles with an external additive thereon) was obtained.

The content $W_{q1}$ of the carnauba wax in the toner base particles in the magenta toner (first toner) was approximately 1.65 mass %, and the content $W_{q2}$ of the synthetic ester wax (other wax) in the magenta toner (first toner) was approximately 3.31 mass %.

(Cyan Toner: Manufacture of Second Toner)

Toner was manufactured in a similar fashion to the magenta toner described above, apart from the fact that a phthalocyanine pigment (Heliogen Blue D 7079 made by BASF) was used instead of a quinacridone pigment, and 2.5 parts by mass of carnauba wax and 2.5 parts by mass of synthetic ester wax were included as waxes instead of 2 parts by mass of carnauba wax and 4 parts by mass of synthetic ester wax.

In this way, cyan toner (toner base particles with an external additive thereon) was obtained.

The content $W_{o1}$ of the carnauba wax in the toner base particles in the cyan toner (second toner) was approximately 2.08 mass %, and the content $W_{o2}$ of the synthetic ester wax (other wax) in the cyan toner (second toner) was approximately 2.08 mass %.

(Manufacture of Developer)

The respective toners obtained as described above were blended with a ferrite carrier having a volume-average particle size of 60 μm (EF-60B made by Powder Tech Co., Ltd.) so as to achieve a toner concentration of 8 mass %. The mixture was churned until it became uniform, in a universal beads mill made by Yamato Scientific Co., Ltd. In this way, a developer was obtained.

Practical Examples 2 to 6 and Comparative Examples 1 to 6

In the magenta toners (first toners) and cyan toners (second toners) in Practical Examples 2 to 6 and Comparative Examples 1 to 6, toner and developer were manufactured in a similar fashion to Practical Example 1, apart from the fact that the respective contents of carnauba wax and synthetic ester wax were changed to the content values indicated in Table 1. Table 1 shows the contents of carnauba wax and synthetic ester wax in each of the magenta toners (first toners) and cyan toners (second toners) in Practical Examples 1 to 6 and Comparative Examples 1 to 6.

TABLE 1

| | Magenta toner | | Cyan toner | |
|---|---|---|---|---|
| | Content per 100 parts by mass of toner base particles (parts by mass) | | | |
| | Carnauba wax | Synthetic ester wax | Carnauba wax | Synthetic ester wax |
| Practical Example 1 | 2 | 4 | 2.5 | 2.5 |
| Practical Example 2 | 1.5 | 4 | 2.5 | 2.5 |
| Practical Example 3 | 2 | 4 | 1.5 | 2.5 |
| Practical Example 4 | 1.6 | 3.5 | 2.5 | 2.5 |
| Practical Example 5 | 2 | 4 | 2.8 | 2.8 |
| Practical Example 6 | 4.5 | 1.5 | 4.5 | 1 |
| Comparative Example 1 | 2 | 4 | 1 | 2.5 |
| Comparative Example 2 | 1.5 | 3 | 2.5 | 2.5 |
| Comparative Example 3 | 2 | 4 | 3.2 | 3.2 |
| Comparative Example 4 | 5 | 1 | 4.5 | 1 |
| Comparative Example 5 | 2 | 4 | 1.4 | 1.4 |
| Comparative Example 6 | 6 | 7 | 2.5 | 2.5 |

Furthermore, the following figures were calculated from the contents of carnauba wax and synthetic ester wax in each of the magenta toners (first toners) and cyan toners (second toners) in Practical Examples 1 to 6 and Comparative Examples 1 to 6, which are shown in Table 1, and the figures thus calculated are shown in Table 2. More specifically, the figures calculated and shown in Table 2 are: firstly, the content of carnauba wax $W_{q1}$ (mass %) in the toner base particles in the respective magenta toners (first toners), the content of synthetic ester wax (other wax) $W_{q2}$ (mass %) in the toner base particles in the respective magenta toners (first toners), the content of carnauba wax $W_{o1}$ (mass %) in the toner base particles in the respective cyan toners (second toners), and the content of synthetic ester wax (other wax) $W_{o2}$ (mass %) in the toner base particles in the respective cyan toners (second toners).

Moreover, Table 2 also shows calculations for the total amount of wax ($W_{q1}+W_{q2}$) in each of the magenta toners (first toners) and the total amount of wax ($W_{o1}+W_{o2}$) in each of the cyan toners (second toners), on the basis of the values of $W_{q1}$, $W_{q2}$, $W_{o1}$, $W_{o2}$ calculated above.

In addition to this, Table 2 also shows a calculation of the ratio of carnauba wax to the total amount of wax ($W_{q1}/(W_{q1}+W_{q2})$) in each of the magenta toners (first toners) and the ratio of carnauba wax to the total amount of wax ($W_{o1}/(W_{o1}+W_{o2})$) in each of the cyan toners (second toners), on the basis of the values of $W_{q1}$, $W_{q2}$, $W_{o1}$, $W_{o2}$, $W_{q1}+W_{q2}$, $W_{o1}+W_{o2}$ calculated above.

TABLE 2

| | Magenta toner | | | | Cyan toner | | | |
|---|---|---|---|---|---|---|---|---|
| | $W_{q1}$ (mass %) | $W_{q2}$ (mass %) | $W_{q1}+W_{q2}$ | $W_{q1}/(W_{q1}+W_{q2})$ | $W_{o1}$ (mass %) | $W_{o2}$ (mass %) | $W_{o1}+W_{o2}$ | $W_{o1}/(W_{o1}+W_{o2})$ |
| Practical Example 1 | 1.65 | 3.31 | 4.96 | 0.33 | 2.08 | 2.08 | 4.17 | 0.50 |
| Practical Example 2 | 1.24 | 3.32 | 4.56 | 0.27 | 2.08 | 2.08 | 4.17 | 0.50 |
| Practical Example 3 | 1.65 | 3.31 | 4.96 | 0.33 | 1.26 | 2.10 | 3.36 | 0.38 |
| Practical Example 4 | 1.33 | 2.91 | 4.25 | 0.31 | 2.08 | 2.08 | 4.17 | 0.50 |
| Practical Example 5 | 1.65 | 3.31 | 4.96 | 0.33 | 2.32 | 2.32 | 4.64 | 0.50 |
| Practical Example 6 | 3.72 | 1.24 | 4.96 | 0.75 | 3.73 | 0.83 | 4.56 | 0.82 |
| Comparative Example 1 | 1.65 | 3.31 | 4.96 | 0.33 | 0.84 | 2.11 | 2.95 | 0.29 |
| Comparative Example 2 | 1.26 | 2.51 | 3.77 | 0.33 | 2.08 | 2.08 | 4.17 | 0.50 |
| Comparative Example 3 | 1.65 | 3.31 | 4.96 | 0.33 | 2.64 | 2.64 | 5.27 | 0.50 |
| Comparative Example 4 | 4.13 | 0.83 | 4.96 | 0.83 | 3.73 | 0.83 | 4.56 | 0.82 |
| Comparative Example 5 | 1.65 | 3.31 | 4.96 | 0.33 | 1.19 | 1.19 | 2.38 | 0.50 |
| Comparative Example 6 | 4.69 | 5.47 | 10.16 | 0.46 | 2.08 | 2.08 | 4.17 | 0.50 |

[Evaluation]

The toners and developers thus obtained were evaluated by the method described below.

(Storage Stability)

Firstly, 10 g of each toner obtained was weighed out and sealed in a 50 $cm^3$ sample jar. The sealed sample jar was placed in a thermostatic bath (PS-212 made by Espec Co., Ltd.) and heat treatment was carried out by setting the interior of the tank to 50° C. in a dry state, and leaving for 100 hours.

Thereupon, the toner was extracted from the sample jar which had been subjected to heat treatment. The extracted toner was passed through a sieve. More specifically, a sieve having a 140 mesh (mesh hole 106 μm) was set in a powder tester (Hosokawa Micron Co., Ltd.) and the extracted toner was passed through the sieve by applying a vibration to the toner for 30 seconds at a rheostat setting of 5.

In this, the weight of toner which passed through the sieve and the weight of toner left in the sieve was measured. The passage rate (%) was calculated from Formula (I) below, using the measured weight values.

$$\text{Passage rate (\%)} = \text{weight of toner passed through sieve (g)} / (\text{weight of toner passed through sieve (g)} + \text{weight of toner left in sieve (g)}) \times 100 \quad \text{(I)}$$

If the passage rate thus obtained was 95% or above, then an "A" assessment was awarded, and if the passage rate thus obtained was less than 95%, then a "B" assessment was awarded.

(Fixing Properties)

Firstly, using a modified color MFP made by Kyocera Co., Ltd. (KM-3232) tuned to a process speed of 250 mm/sec linear speed, and a fixing temperature of 140° C., as an evaluator, using the respective developers obtained above as starting developers, and using the respective toners obtained above as replenishment toners, image formation was carried out under normal temperature and normal humidity conditions of 20° C. to 23° C. temperature and 50% to 65% RH, and the following assessments were made.

More specifically, firstly, the starting developers were set in the developer accommodating units corresponding to the respective colors of the evaluator, and the power supply of the evaluator was switched on and stabilized. Thereupon, an image having a print rate of 25% (horizontal bands) was output onto 1000 sheets of paper using a solid mixed blue color (a mixture of magenta 100% and cyan 100%).

Thereupon, a visual inspection was made to check whether or not toner was adhering to the fixing roller. If adherence of toner was not confirmed, then an "A" assessment was awarded for fixing properties, and if adherence of toner was confirmed, than a "B" assessment was awarded for fixing properties.

(Separability)

After carrying out the image formation described above (outputting 1000 sheets), it was confirmed whether or not a jam had occurred due to paper wrapping about the fixing roller. If a jam had not occurred, then an "A" assessment was awarded as an evaluation of separability, and if a jam had occurred, then a "B" assessment was awarded as an evaluation of separability.

(Resistance to Adhesion)

After carrying out the image formation described above (outputting 1000 sheets), it was confirmed visually whether or not there was toner adhering to the photoconductive drum. If adherence of toner was not confirmed, then an "A" assessment was awarded for resistance to adhesion, and if adherence of toner was confirmed, than a "B" assessment was awarded for resistance to adhesion.

(Overall Evaluation)

If all of the evaluation items had an "A" assessment, then an "A" was awarded, and if any one of the evaluations items had a "B" assessment, then a "B" was awarded.

The corresponding evaluation results are shown in Table 3.

TABLE 3

| | Storage stability | | | | | | | |
|---|---|---|---|---|---|---|---|---|
| | Magenta toner | | Cyan toner | | | | | |
| | Passage rate (%) | Evaluation | Passage rate (%) | Evaluation | Fixing properties | Separability | Resistance to adhesion | Overall evaluation |
| Practical Example 1 | 96.5 | A | 97.4 | A | A | A | A | A |
| Practical Example 2 | 97.5 | A | 98.1 | A | A | A | A | A |
| Practical Example 3 | 96.7 | A | 98.3 | A | A | A | A | A |
| Practical Example 4 | 98.3 | A | 97.8 | A | A | A | A | A |
| Practical Exannple 5 | 97.2 | A | 96.7 | A | A | A | A | A |
| Practical Example 6 | 98.0 | A | 98.1 | A | A | A | A | A |
| Comparative Example 1 | 96.2 | A | 96.7 | A | B | B | A | B |
| Comparative Example 2 | 96.8 | A | 97.4 | A | B | B | A | B |
| Comparative Example 3 | 96.1 | A | 92.0 | B | A | A | B | B |
| Comparative Example 4 | 98.1 | A | 98.0 | A | A | B | A | B |
| Comparative Example 5 | 96.5 | A | 96.6 | A | B | B | A | B |
| Comparative Example 6 | 86.9 | B | 98.0 | A | A | A | B | B |

As Table 3 reveals, in cases where the wax contents of the first toner (magenta toner) and the second toner (cyan toner) satisfy Formula (1) and Formula (2) stated above (Practical Examples 1 to 6), better storage stability, fixing properties, separability and resistance to adhesion are achieved than in cases where either one of Formula (1) and Formula (2) stated above are not satisfied (Comparative Examples 1 to 6).

The present specification discloses various modes of technology, as described above, but the main technologies of these are summarized below.

One aspect of the present invention is a toner set comprising a plurality of toners used in an image forming method for forming an image by forming a toner image composed of toners of a plurality of colors and fixing the toner image thus formed onto a recording medium, wherein the toners of a plurality of colors comprise a first toner and a second toner of a different color from the first toner; the first toner and the second toner respectively contain toner base particles including a binding resin, a colorant and a wax, the colorant of the first toner contains a quinacridone pigment; the wax includes a carnauba wax and a wax other than the carnauba wax; and when the contents of the carnauba wax in the first toner, the other wax in the first toner, the carnauba wax in the second toner, and the other wax in the second toner in the toner base particles of the respective toners, are respectively $W_{q1}$ mass %, $W_{q2}$ mass %, $W_{o1}$ mass %, and $W_{o2}$ mass %, Formula (1) and Formula (2) below are satisfied:

$$W_{q1}/(W_{q1}+W_{q2})<W_{o1}/(W_{o1}+W_{o2}) \quad (1)$$

$$3 \leqq W_{o1}+W_{o2}<W_{q1}+W_{q2} \leqq 10 \quad (2).$$

According to the composition described above, even if used in an image forming method which forms an image by forming a toner image composed of toners of a plurality of colors and fixing the toner image thus formed onto a recording medium, the respective toners can display excellent storage stability, fixing properties, separability and resistance to adhesion.

This is thought to be because of the following reasons.

Firstly, it is thought that by using carnauba wax and another wax in combination as the wax, a suitable dispersion of the wax into the binding resin is achieved, as stated above, and the fixing properties and separability can be improved while maintaining good resistance to adhesion.

It is also considered that, as stated previously, by making the ratio of the carnauba wax in the first toner which contains a quinacridone pigment relatively smaller than the second toner and by making the total amount of wax in the first toner relatively greater than the second toner, it is possible to achieve good balance of the fixing properties.

Moreover, it is thought that by setting the total amount of wax in the first toner and the second toner to within the range described above, it is possible to ensure good storage stability of the toner while also achieving good fixing properties, separability and resistance to adhesion. If the toner stability is poor, then when carrying out permanent printing, or the like, which involves printing continuously for a long period of time, for example, the wax in the toner is transferred to the carrier and there is a risk that decline in the developing properties, or the like, will occur due to charging defects.

Desirably, in the toner set described above, Formula (3) below is satisfied:

$$4 \leqq W_{o1}+W_{o2}<W_{q1}+W_{q2}<8 \quad (3).$$

According to a composition of this kind, each respective toner is able to display excellent storage stability, fixing properties, separability and resistance to adhesion.

Furthermore, desirably, in the toner set described above, when carrying out the toner image formation, the second toner is toner used immediately before or immediately after the first toner is used.

By adopting a composition of this kind, better balance of fixing properties is obtained between the first toner and the second toner, and hence each of the toners is able to display more satisfactory fixing properties.

Furthermore, desirably, in the toner set described above, the other wax is a synthetic ester wax.

According to a composition of this kind, each respective toner is able to display excellent storage stability, fixing properties, separability and resistance to adhesion.

Moreover, a further aspect of the present invention is a developer set, comprising developers of a plurality of colors, wherein the developers of a plurality of colors comprise a developer containing a first toner of the toner set and a carrier, and a developer containing a second toner of the toner set and a carrier.

According to the composition described above, it is possible to provide a developer set having toners which, even if used in an image forming method which forms an image by forming a toner image composed of toners of a plurality of colors and fixing the toner image thus formed onto a recording medium, can display excellent storage stability, fixing properties, separability and resistance to adhesion.

Moreover, a further aspect of the present invention is an image forming apparatus, comprising: a plurality of image bearing members arranged in parallel in a prescribed direction in order to form toner images using toners of different colors on the surfaces thereof; and a plurality of developing devices, disposed facing the respective image bearing members, which supply toner contained in developer to the surfaces of the respective image bearing members; wherein the developers used in the plurality of developing devices are respective developers of the developer set.

According to the composition described above, even if constant printing is carried out by printing continuously over a long period of time, it is possible to print with good image quality while suppressing the incidence of jams, or the like, caused by paper wrapping about the fixing roller, or the like.

Moreover, a further aspect of the present invention is an image forming method, comprising a step of: forming toner images using toners of different colors on the surfaces of a plurality of image bearing members arranged in parallel in a prescribed direction, by supplying, to the surfaces of the respective image bearing members, toners contained in developers accommodated in a plurality of developing devices disposed facing the image bearing members, respectively, wherein the respective developers of the developer set are used as the developers accommodated in the plurality of developing devices.

According to the composition described above, even if constant printing is carried out by printing continuously over a long period of time, it is possible to print with good image quality while suppressing the incidence of jams, or the like, caused by paper wrapping about the fixing roller, or the like.

According to the present invention, it is possible to provide a toner set comprising toners of a plurality of colors, having excellent toner storage stability, fixing properties, separability and resistance to adhesion. Furthermore, the present invention provides a developer set comprising a plurality of developers containing respective toners of the toner set and a carrier, an image forming apparatus which uses the developers of the developer set, and an image forming apparatus which uses the developers of the developer set.

This application is based on Japanese Patent application serial No. 2009-195223 filed in Japan Patent Office on Aug. 26, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A toner set, comprising a plurality of toners used in an image forming method for forming an image by forming a toner image composed of toners of a plurality of colors and fixing the toner image thus formed onto a recording medium, wherein the toners of a plurality of colors comprise a first toner and a second toner of a different color from the first toner, the first toner and the second toner respectively contain toner base particles including a binding resin, a colorant and a wax, the colorant of the first toner contains a quinacridone pigment, the wax includes a carnauba wax and a wax other than the carnauba wax, the toner base particles of the first toner have a mass % $W_{q1}$ of carnauba wax and $W_{o1}$ of the other wax and the toner base particles of the second toner have a mass % $W_{q2}$ of carnauba wax and $W_{o2}$ of the other wax, and these mass % values are selected to satisfy Formula (1) and Formula (2) below $$W_{q1}/(W_{q1}+W_{q2})<W_{o1}/(W_{o1}+W_{o2}) \quad (1)$$

$$3 \leqq W_{o1}+W_{o2}<W_{q1}+W_{q2} \leqq 10 \quad (2).$$

2. The toner set according to claim 1, where Formula (3) below is satisfied:

$$4 \leqq W_{o1}+W_{o2}<W_{q1}+W_{q2} \leqq 8 \quad (3).$$

3. The toner set according to claim 1, wherein when carrying out the toner image formation, the second toner is toner used immediately before or immediately after the first toner is used.

4. The toner set according to claim 1, wherein the other wax is a synthetic ester wax.

5. A developer set, comprising developers of a plurality of colors, wherein the developers of a plurality of colors comprise a developer containing the first toner of the toner set according to claim 1 and a carrier, and a developer containing the second toner of the toner set and a carrier.

6. An image forming apparatus, comprising:

a plurality of image bearing members arranged in parallel in a prescribed direction in order to form toner images using toners of different colors on the surfaces thereof; and a plurality of developing devices which are disposed facing the respective image bearing members and supply toners contained in developers to the surfaces of the respective image bearing members, wherein the developers used in the plurality of developing devices are the respective developers of the developer set according to claim 5.

7. An image forming method, comprising a step of:

forming toner images using toners of different colors on the surfaces of a plurality of image bearing members arranged in parallel in a prescribed direction, by supplying, to the surfaces of the respective image bearing members, toners contained in developers accommodated in a plurality of developing devices disposed facing the image bearing members, respectively, wherein the respective developers of the developer set according to claim 5 are used as the developers accommodated in the plurality of developing devices.

* * * * *